United States Patent [19]

Shields

[11] 4,175,683

[45] Nov. 27, 1979

[54] SKI POLE BASKET AND CARRYING ASSEMBLY

[76] Inventor: Michael P. Shields, 5977 Reseda Blvd., Tarzana, Calif. 91356

[21] Appl. No.: 783,170

[22] Filed: Mar. 31, 1977

[51] Int. Cl.[2] ..... B65D 71/00

[52] U.S. Cl. ..... 224/45 S; 280/11.37 A; 280/11.37 Z

[58] Field of Search ..... 224/45 S, 5 Z; 280/11.37 R, 11.37 B, 11.37 D, 11.37 H, 11.37 L, 11.37 F, 11.37 N, 11.37 Z, 11.37 P, 11.37 E, 11.37 J, 11.37 K, 11.37 A

[56] References Cited

U.S. PATENT DOCUMENTS

| | | | |
|---|---|---|---|
| 3,504,405 | 4/1970 | Elliot-Smith | 280/11.37 K |
| 3,687,472 | 8/1972 | Struble, Jr. | 280/11.37 B |
| 3,830,416 | 8/1974 | Smedley | 224/45 S |
| 3,976,234 | 8/1976 | Moudry et al. | 224/45 S |

FOREIGN PATENT DOCUMENTS

| | | | |
|---|---|---|---|
| 842085 | 5/1970 | Canada | 280/11.37 B |
| 684566 | 11/1939 | Fed. Rep. of Germany | 280/11.37 N |
| 1522547 | 3/1968 | France | 280/11.37 Z |

*Primary Examiner*—Joseph F. Peters, Jr.
*Assistant Examiner*—D. W. Underwood
*Attorney, Agent, or Firm*—Lyon & Lyon

[57] ABSTRACT

Disclosed herein is a ski pole basket, a portion of said basket defining a locking clip for securing the basket to a pair of skis, each basket having a gripping surface thereon for securing the basket to the handle of the second pole such that the two poles with their handles and baskets so secured define a carrying assembly for the poles and skis.

4 Claims, 5 Drawing Figures

SKI POLE BASKET AND CARRYING ASSEMBLY

BACKGROUND OF THE INVENTION

The present invention relates to a basket for a ski pole which defines a carrying assembly for the snow skier's poles and skis. Snow skis and poles are inherently bulky and unwieldy and accordingly have presented a handling problem when they must be manually carried over any distance. While a few devices have been developed in an attempt to assist the skier in handling his equipment, such as those described in U.S. Pat. Nos. 3,877,623 and 3,774,826, these devices have met with little acceptance as they have merely substituted one problem for another. Any benefit obtained from such devices in facilitating the carrying of one's equipment is offset by the added problem of storing such a device while skiing. As convenient storage facilities are not always readily available and many skiers wish to spend every available minute on the slopes as opposed to searching out such facilities, additional carrying equipment has proved to be quite unpopular. Accordingly, skiers have continued to either secure their skis together with the conventional rubber straps or the like or secure the safety straps of the ski poles about the skis in any number of ways in an attempt to reduce the unwieldness of their equipment. The inevitable result of many such attempts is a comical spectacle involving the knocking and scraping together of the skis causing damage and dulling to the edges of the skis and often injury to passers-by.

SUMMARY OF THE INVENTION

Briefly, the present invention relates to a basket for a ski pole which is readily secured to the handle of the other pole and about a pair of skis such that upon securing each of the ski pole baskets to the handle of the other pole, a carrying assembly is defined to which the skis can be readily secured and easily carried with the poles.

It is therefore the principal object of the present invention to provide an improved assembly for facilitating the carrying of snow skis and ski poles.

It is another object of the present invention to provide an assembly for carrying snow skis and ski poles which obviates the need for an additional carrying device.

It is a further object of the present invention to provide a basket for a ski pole having means thereon for securing the basket to the handle of another ski pole without interfering with the use of the pole when skiing.

It is a still further object of the present invention to provide a ski pole basket capable of being secured to the handle of another ski pole and to a pair of snow skis.

These and other objects and advantages of the present invention will become apparent from the following detailed description taken in conjunction with the accompanying drawings.

DESCRIPTION OF THE PREFERRED EMBODIMENT

IN THE DRAWINGS

Figure 2:
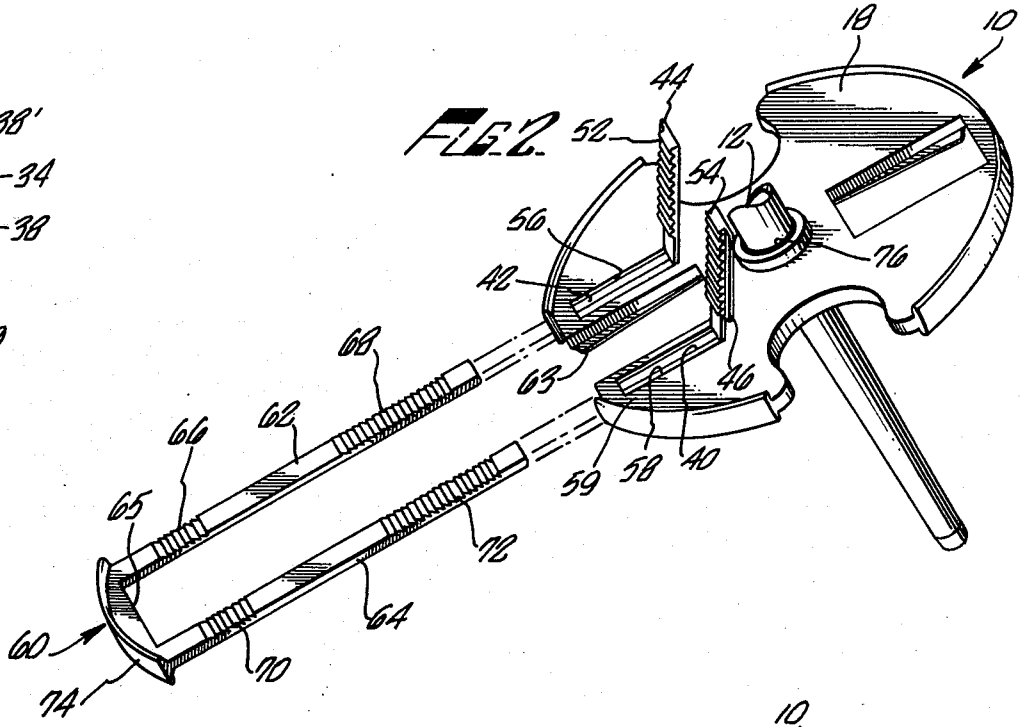
FIG. 2 is an exploded perspective view of the basket of the present invention.
Figure 1:
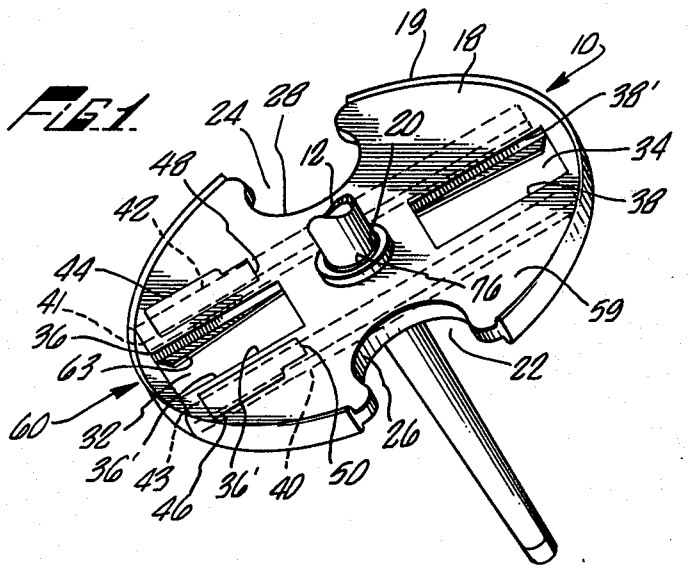
FIG. 1 is a perspective view of a portion of a ski pole provided with a basket of the present invention.

Referring now in detail to the drawings, the ski pole basket assembly 10 of the present invention when rigidly secured to a ski pole 12 is adapted for securing together for carrying the pole 12, a second pole 14 similarly equipped with a basket assembly 10 and a pair of skis 16. The basket assembly 10 is comprised of a disc-shaped body member 18 having an outer rim 19 extending about the perimeter thereof, a central aperture 20 therein for receiving the ski pole, a pair of diametrically opposed recessed areas 22 and 24 defined by curvilinear surfaces 26 and 28 respectively which extend over center to reduce the transverse dimension of the outer open end thereof and thereby define handle gripping surfaces for receiving and securing the basket assembly to the handle 30 of the second pole 14, and a second pair of diametrically opposed rectangular recessed areas 32 and 34 defined by U-shaped walls 36 and 38. Recessed area 32 is adapted to receive a pair of skis 16 in a manner to be described and area 34 is solely provided for symmetry and balance, but, in fact, is not required.

A pair of elongated slots 40 and 42 having open ends 41 and 43 extend through the body member 18 of the basket assembly on either side of central aperture 20 parallel to the side walls 36' and 38' of the rectangular recessed areas 32 and 34. Locking members 44 and 46 are hingedly secured to the body member 18 of the basket assembly at 48 and 50 respectively. Each of the locking members carries a plurality of locking teeth 52 and 54 extending downwardly therefrom into slots 40 and 42 through openings 56 and 58 in the upper surface 59 of the body members, which openings communicate with the interior of the elongated slots 40 and 42.

A U-shaped ski locking member 60 comprised of arm portions 62 and 64 and a transverse bar 65 is provided for securing the skis 16 to the basket assembly 10. The arm portions 62 and 64 of the locking member 60 extend into the elongated slots 40 and 42 respectively in the body member 18 of the basket assembly and are provided with pairs of spaced pluralities of locking teeth, 66 and 68 on arm 62 and teeth 70 and 72 on arm 64. Each of the pluralities of locking teeth on arm 62 are adapted to mate with the locking teeth 52 on locking member 44 which teeth 52 extend into slot 42 through opening 56 and the teeth on arm 64 mate with the locking teeth 46 on locking member 54. Through this construction, the ski locking member 60 can be secured to the body member 18 of the basket assembly 10 in two adjustable positions, i.e., a closed position and an extended position. In the closed position, the ski locking member 60 is inserted all the way into the body member 18 such that the outer rim portion 74 of the transverse bar 65 of the ski locking member 60 is continuous with and the outer rim 19 of the body member 18 of the basket assembly and extends across the outer open end of the rectangular recessed area 32 and the locking teeth on locking members 44 and 46 mate with the locking teeth 68 and 72 on arm portions 62 and 64 respectively to secure the ski locking member 60 in place. In the extended or ski carrying position, the locking teeth on locking members 44 and 46 mate with the locking teeth 66 and 70 on the arm portions 62 and 64 of the ski locking members to again secure the ski locking member in place, albeit in an extended position.

Figure 3:
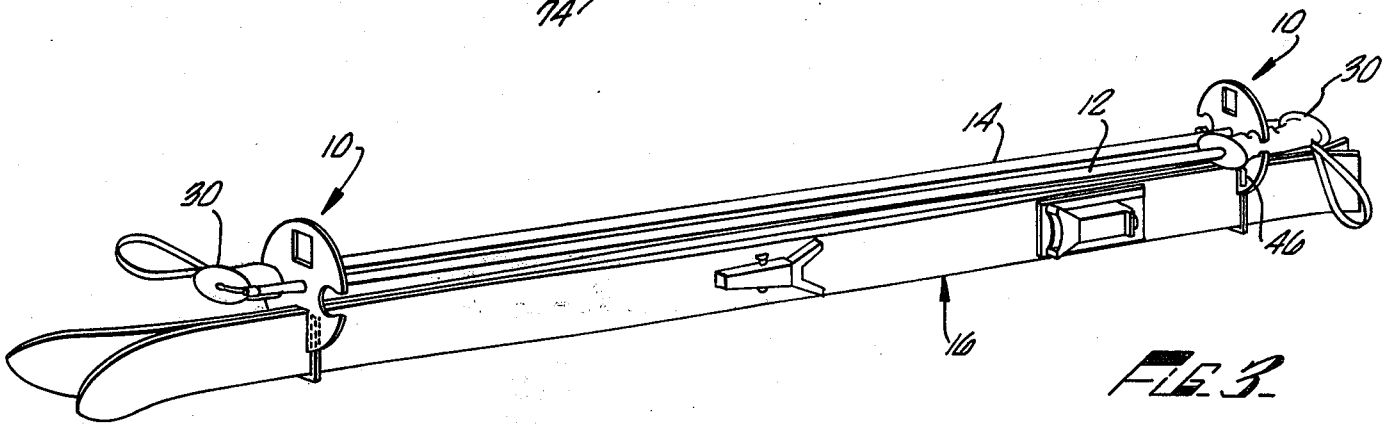
FIG. 3 is a plan view of a pair of snow skis and ski poles held together by a pair of baskets of the present invention.

In use, the ski locking member 60 is secured to the body member 18 of the basket assembly 10 in the closed position while skiing. So secured, the basket assembly functions in the same manner as a conventional ski pole basket. To secure the skis and the poles together for easy carrying, as illustrated in FIG. 3, the ski pole handles 30 are each inserted into one of the recessed areas 22 or 24 in the body members 18 of the basket assemblies 10 thereby locking the poles together. To prevent having to realign the recessed areas in the basket assemblies with the poles for each carrying operation, the basket assemblies are rigidly mounted by a frictional ring 76 or other suitable means such that the recessed areas face the front or, if a better mating fit can be obtained, the rear of the ski pole handle and is prevented from rotating with respect to the pole and handle. It is, of course, understood that the configuration of the recessed areas defined by the curvilinear gripping surfaces 26 and 28 would vary according to the ski pole handle configuration. While an over center circular configuration is illustrated in the drawings, if the ski pole handle were of a different configuration such as that found on the new right and left handed ski poles, the gripping surfaces would conform to such a configuration with a portion thereof again reducing the transverse dimension of the outer open end of the recessed area to hold the handle therein and the basket assemblies would be fixed to the poles in the proper angular orientation so as to properly align the recessed areas with the handles.

With the ski poles secured together by the basket assemblies 10, the skis 16 could be carried by means of the conventional handle straps, however, the use of the ski locking means 60 tightly secures the skis and poles together to further facilitate the carrying of such equipment. To secure the skis 16 to the joined poles, the pivotally mounted locking members 44 and 46 on the body member 18 of the basket assembly are pivoted upwardly disengaging the locking teeth 52 and 54 carried thereby from the locking teeth 68 and 72 on the arm portions 62 and 64 of the ski locking member 60. The ski locking member 60 is then removed from the base member 18 and a transverse portion of the skis are inserted into the rectangular recessed area 32 in the base member. The parallel wall portions 36′ defining area 32 are provided with integrally formed tapered flexible protrusions 63 and 65 which together with the natural camber in the skis provide a snug fit for the skis within the recessed area and eliminate any undesirable wobble. The ski locking member is then reinserted into the base member about the portion of the skis extending from the recessed area 32 with the transverse bar portion 65 pressing against the extended edges 80 of the skis. The locking members 44 and 46 are then pivoted downwardly such that the locking teeth 52 and 54 carried thereby mate with the locking teeth 66 and 70 on the arm portions 62 and 64 of the ski locking member. In this position, the skis are securely held to the base portion of the basket assembly 10 by means of the ski locking member. The skis are then similarly secured to the basket assembly 10 carried by the other secured ski pole whereupon the skis and poles are securely joined together with the poles lying in a common plane and the skis depending therefrom. The skis and poles can then be readily carried by merely lifting the poles near the midpoint thereof.

As noted above, rectangular recessed area 34 is not used for carrying equipment. Similarly, only one recessed area for receiving and securing the basket assembly to a ski pole handle need be included and two are shown solely to present a symmetrical appearance and to balance the basket assembly. Accordingly, either recessed area 22 or 24 and recessed area 34 need not be included on the body member 18. Alternately, pivotally mounted flap portions (not shown), could be provided to extend over each of the recessed areas to prevent the basket assembly from being entangled by brush or debris while skiing. If such flaps were employed, they would preferably extend from the underside of the basket over the rim portion thereof and be secured on the upper surface to accommodate the flexing of the basket assemblies while the pole is being planted in the snow for executing a turn while skiing.

Figure 5:
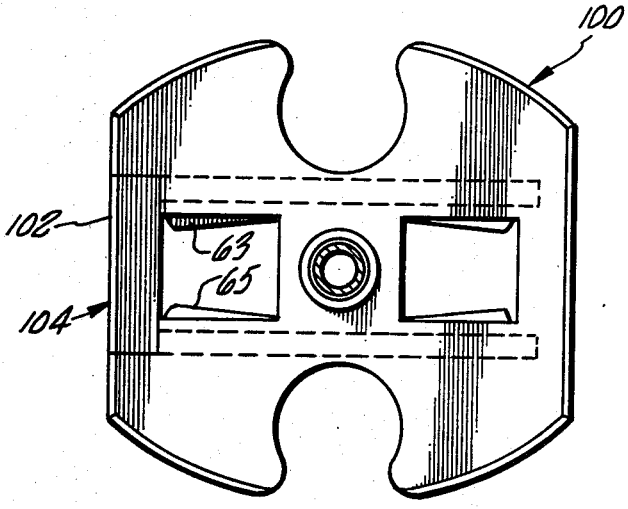
FIG. 5 is a second embodiment of the ski basket of the present invention.

Another modification of the basket assembly is illustrated in FIG. 5. As shown therein, the base member portion 100 of the assembly is of an elliptical configuration as opposed to the circular configuration of base member 18 of the prior embodiment, and the outer rim portion 102 of the ski locking member 104 defines a flat surface as opposed to the rounded surface of rim portion 74 in the prior embodiment. This elliptical configuration of base member 100 increases the spacing between the ski poles and the edge of the skis when secured together thereby facilitating grasping the poles for carrying. In addition, the flat outer rim portion 102 of the ski locking members 104 slightly increase the distance between the basket assemblies and the skis while skiing to provide a degree of compensation for the elliptical configuration and thereby reduce the chance of the basket assemblies interfering with the skis while skiing. In addition, the flat surface provides a resting surface for the poles and skis to restrain the equipment from rolling on the ground.

Figure 4:
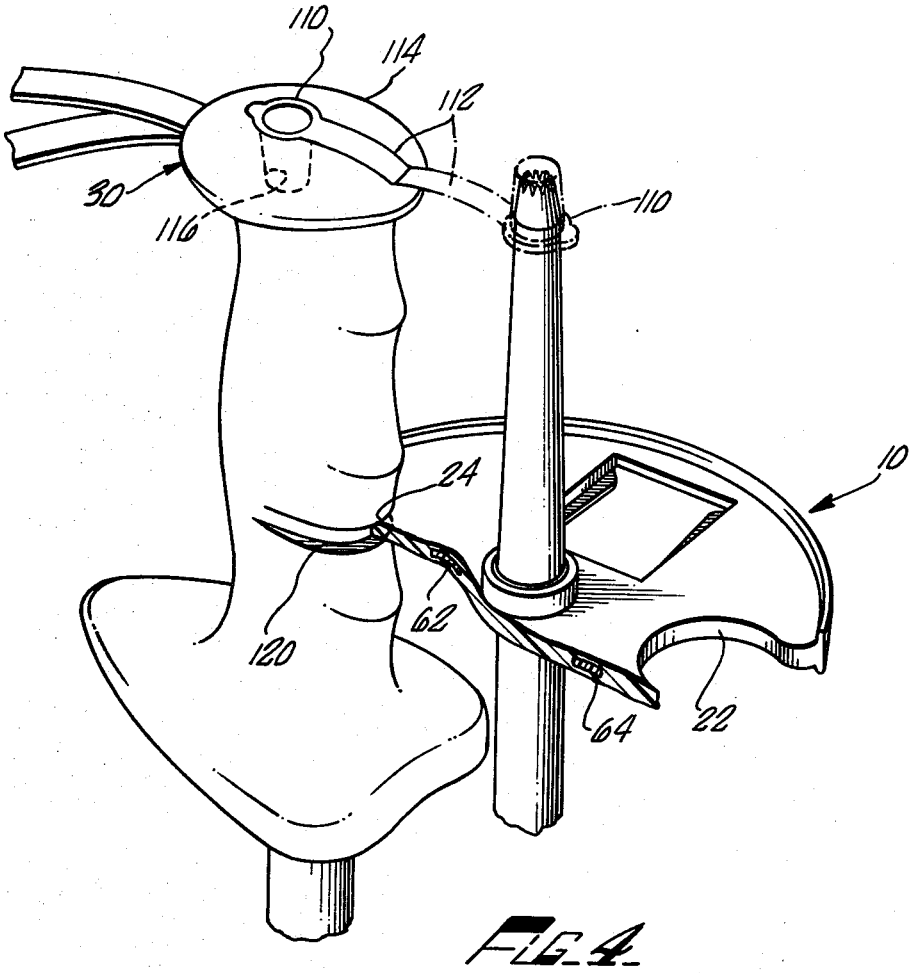
FIG. 4 is a side view of a ski pole handle used with the basket of the present invention.

Another feature provided by the present invention is illustrated in FIG. 4. Because the basket assembly 10 secures the handle of one pole adjacent the tip of the second pole, the ski pole handle 30 can be provided with a protective cap 110 which is adapted to fit over the tip of the adjacent pole and which is carried by a flexible strap 112 secured to the butt portion 114 of the ski pole handle. When not in use, the protective cap is held within a recessed area 116 in the butt of the ski pole handle. In this manner, a protective cap is provided for the ski pole tips for carrying and storage which cannot be misplaced and need not be stored separately while skiing. In addition, if desired, an alignment groove 120 can be provided in the ski pole handle for receiving the portion of the body member 18 disposed about the recessed handle receiving area.

Other changes and modifications to the present invention could include variations in the positioning of the mating teeth on the ski locking member 60 and body member 18. For example, the pairs of teeth on the ski locking member could be disposed along the sides of the arm portions thereof and the mating teeth on the body member along the interior side walls of slots 40 and 42. In such a case, the slots would most likely not be parallel with the side walls 36′ and 38′ of the ski receiving rectangular recessed areas 32 and 34 but would flare outwardly and be open along the upper ends thereof to accommodate a tab extending therethrough from the arm portions of the ski locking member. To remove the ski locking member from the body member, the tabs would be pressed together disengaging the locking teeth and allowing the ski locking members to be slided from the body member. In another variation of the invention, also not shown, the sides of the skis could be provided with a plurality of locking teeth disposed thereon by a pressure sensitive adhesive, which teeth would then mate with a plurality of locking teeth disposed on the side walls 36' of recessed area 38. In such an embodiment, the ski locking member would comprise the skis themselves.

Various other changes and modifications may be made in carrying out the present invention without departing from the spirit and scope thereof. Insofar as these changes and modifications are within the purview of the appended claims, they are to be considered as part of the present invention.

I claim:

1. A basket assembly for a ski pole for use in securing together a pair of skis and a pair of ski poles to facilitate the carrying thereof, said basket assembly comprising a body member having an aperture extending therethrough for receiving a first ski pole, a first recessed area therein for receiving a portion of a second ski pole, the area defining a curvilinear gripping surface for retaining said second ski pole within said recessed area, said gripping surface defining an outer opening to said recessed area of reduced transverse dimension and a second recessed area radially disposed within said body member at about 90° with respect to said first recessed area for receiving a transverse portion of a pair of adjacently disposed skis, a U-shaped ski locking member defining a bar and leg portions, the bar portion of said ski locking member extending across the outer open end of said second recessed area and being adapted to be disposed about the transverse portion of said skis extending from said second recessed area and the leg portions of said ski locking member extending into said body member about said second recessed area and including means for locking said second portion of said ski locking member within said body member.

2. The combination of claim 1 wherein said locking means comprises a first plurality of locking teeth carried by said leg portions of said ski locking member and a second plurality of locking teeth carried by said base member, said second plurality of locking teeth being adapted to mate with said first plurality of locking teeth for securing said ski locking member within said base member upon disposing said bar portion of said locking member about said transverse portions of said skis.

3. The combination of claim 2 including a third plurality of locking teeth, said teeth being carried by said leg portions of said ski locking member outwardly spaced thereon from said first plurality of locking teeth, said third plurality of locking teeth being adapted to mate with said second plurality of locking teeth carried by said base member for securing said ski locking member to said body member such that said bar portion of said ski locking member extends across the open end of said second recessed area in said body member defining a continuous portion of the perimeter surface of said body member.

4. The combination of claim 3 wherein said second plurality of locking teeth are hingedly mounted on said base member such that said teeth can be readily disengaged from said first and third pluralities of locking teeth on said leg portions of said ski locking member.

* * * * *